US009741334B2

(12) United States Patent
Park et al.

(10) Patent No.: US 9,741,334 B2
(45) Date of Patent: Aug. 22, 2017

(54) ACTIVE NOISE CANCELLATION IN AUDIO OUTPUT DEVICE

(71) Applicant: Samsung Electronics Co., Ltd., Gyeonggi-do (KR)

(72) Inventors: Cheol Yong Park, Gyeonggi-do (KR); Ju Hee Chang, Gyeonggi-do (KR); Se Jeong Na, Gyeonggi-do (KR); Sung Kyu Park, Gyeonggi-do (KR); In Seok Shim, Gyeonggi-do (KR); Sung Hoon Jeong, Gyeonggi-do (KR); Ho Chul Hwang, Seoul (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/044,381

(22) Filed: Feb. 16, 2016

(65) Prior Publication Data

US 2016/0240185 A1 Aug. 18, 2016

(30) Foreign Application Priority Data

Feb. 16, 2015 (KR) ..... 10-2015-0023364

(51) Int. Cl.

| | |
|---|---|
| ***G10K 11/16*** | (2006.01) |
| ***G10K 11/178*** | (2006.01) |
| *H04R 1/10* | (2006.01) |

(52) U.S. Cl.

CPC ..... *G10K 11/1782* (2013.01); *G10K 11/178* (2013.01); *H04R 1/1083* (2013.01); *G10K 2210/1081* (2013.01); *G10K 2210/3016* (2013.01); *G10K 2210/503* (2013.01); *H04R 1/1041* (2013.01); *H04R 2420/05* (2013.01); *H04R 2420/07* (2013.01); *H04R 2420/09* (2013.01); *H04R 2460/01* (2013.01)

(58) Field of Classification Search

CPC ..... G10K 11/1782; G10K 11/178; G10K 2210/1081; G10K 2210/3016; G10K 2210/503; G10K 2210/108; G10K 2210/3213

USPC ..... 381/71.1–71.6, 58

See application file for complete search history.

(56) References Cited

U.S. PATENT DOCUMENTS

| | | | | |
|---|---|---|---|---|
| 8,315,405 | B2 * | 11/2012 | Bakalos | G10K 11/178 381/71.1 |
| 8,606,572 | B2 | 12/2013 | Zhu et al. | |
| 8,693,700 | B2 | 4/2014 | Bakalos et al. | |
| 2011/0026724 | A1 | 2/2011 | Doclo | |

(Continued)

*Primary Examiner* — Disler Paul

(74) *Attorney, Agent, or Firm* — Cha & Reiter, LLC

(57) ABSTRACT

An audio output device controls the application of active noise cancellation (ANC) levels based on a current status of the device. The audio output device includes a communication interface configured to provide a wired or wireless connection to a playback device, a signal detector configured to detect an audio signal provided through the communication interface, an ANC module configured to apply a first-level ANC to the audio signal, and a control unit configured to determine a level of the ANC to be applied by the ANC module. Upon determining that the audio signal is not provided based on information provided from at least one of the communication interface or the signal detector, the control unit instructs the ANC module to perform a second-level ANC.

18 Claims, 7 Drawing Sheets

(56) References Cited

U.S. PATENT DOCUMENTS

| | | | | |
|---|---|---|---|---|
| 2012/0084084 | A1 | 4/2012 | Zhu et al. | |
| 2012/0250873 | A1 | 10/2012 | Bakalos et al. | |
| 2015/0055789 | A1* | 2/2015 | Bernal Castillo .... | G10K 11/178 381/71.6 |
| 2015/0248879 | A1* | 9/2015 | Miskimen ..... | G10K 11/178 381/71.6 |

* cited by examiner

ACTIVE NOISE CANCELLATION IN AUDIO OUTPUT DEVICE

CLAIM OF PRIORITY

This application claims the benefit of priority under 35 U.S.C. §119(a) from a Korean patent application filed on Feb. 16, 2015 in the Korean Intellectual Property Office and assigned Serial number 10-2015-0023364, the entire disclosure of which is hereby incorporated by reference.

BACKGROUND

Field of the Disclosure

The present disclosure relates to a technology for actively cancelling an ambient noise according to a situation in an audio output device such as a headphone.

Description of the Related Art

An audio output device such as a headphone may be equipped with various noise cancellation technologies. For example, such a headphone may collect an ambient noise via a microphone connected to a noise cancellation circuit, and may output an anti-noise (i.e. noise-canceling) signal having an opposite phase to that of the obtained noise. A mixture of the ambient noise and the anti-noise signal with the opposite phase of the noise is heard by a user, giving a resultant effect of cancelling the noise.

In the case where an audio output device supports active noise cancellation (ANC), a noise can be actively cancelled by collecting ambient noise through a microphone for ANC and determining an ambient noise environment. The audio output device may be designed such that an output unit (e.g., a speaker) cancels an ambient noise so that an audio signal provided from a playback device is clearly provided to a user.

Although application of the ANC to an audio output device brings about a noise reduction effect, an excessive application of the ANC may cause various side effects. For example, if noise reduction is maximized by applying the ANC, a distortion of a frequency response may occur, and may be noticeable to the user when the distortion exceeds a threshold. In other words, in the case where the ANC is applied to a certain degree or more, an output audio signal may be so damaged that a user may recognize it. For another example, if the ANC is enhanced, an arbitrary audio artifact may be induced by the ANC. This artifact may be, for example, a hissing noise heard by a user.

Meanwhile, a user of a headphone may desire to stay in a quiet state by wearing the headphone. For example, in a noisy place such as a bus, a subway, an airplane, or the vicinity of a construction site, the user may desire to avoid a noise by wearing the headphone to shield their ears from the noise. In some cases, the user may wear the headphone when not connected to a playback device, or, in other cases, the user may wear the headphone that is connected to the playback device, but the playback device is not currently playing any audio or video file.

However, a noise reduction technology for an audio device is mainly used for the purpose of providing an audio signal from a playback device with as little additional noise as feasible. That is, if a user does not play any audio signal or even plays an audio signal with a very weak volume while wearing a headphone to avoid an ambient noise, a conventional audio output device provides the ANC, the level of which is suitable only for a normal audio output signal (or the ANC function may not be performed at all), and thus the appropriate level of noise cancellation desired by the user is not achieved.

SUMMARY

Accordingly, an aspect of the present disclosure is to provide a method and device for controlling an ANC function of an audio output device based on a current status of the audio output device.

In accordance with an aspect of the present disclosure, an audio output method and device is provided. The audio output device may include a communication interface configured to provide a wired and/or wireless connection to a playback device, a signal detector configured to detect an audio signal transferred through the communication interface, an active noise cancellation (ANC) module configured to apply a first-level ANC to the audio signal, and a control unit configured to determine a level of the ANC to be applied by the ANC module. If it is determined that the audio signal is not provided based on information provided from at least one of the communication interface or the signal detector, the control unit may instruct the ANC module to perform a second-level ANC.

DETAILED DESCRIPTION

Figure 1:
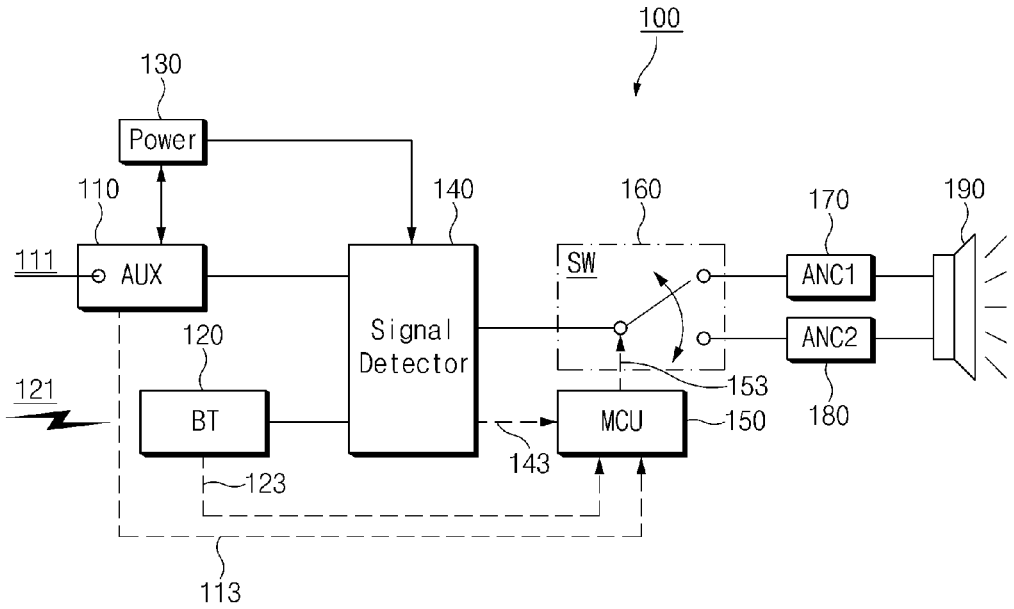
FIG. 1 illustrates an audio output device according to various embodiments of the present disclosure.

Hereinafter, various embodiments of the present disclosure will be described in more detail with reference to the accompanying drawings. However, a person of ordinary skill in the art should be understood that the present disclosure is not limited to specific embodiments shown and described herein, but rather includes various modifications, equivalents and/or alternatives of such various embodiments of the present disclosure. Regarding description of the drawings, like reference numerals may refer to like elements.

The terms "have", "may have", "include", "may include", "comprise", or the like used herein indicates the existence of a corresponding feature (e.g., a number, a function, an operation, or an element) and does not exclude the existence of an additional feature or features.

The term "A or B", "at least one of A and/or B", or "one or more of A and/or B" may include all possible combinations of items listed together. For example, the term "A or B", "at least one of A and B", or "at least one of A or B" may indicate all the cases of (1) including at least one A, (2) including at least one B, and (3) including at least one A and at least one B.

The term "first", "second" or the like used herein may modify various elements regardless of the order and/or priority thereof, but does not limit the elements. For example, "a first user device" and "a second user device" may indicate different user devices regardless of the order or priority. For example, without departing the scope of the present disclosure, a first element may be referred to as a second element and vice versa.

It will be understood by a person of ordinary skill in the art that when a certain element (e.g., a first element) is referred to as being "operatively or communicatively coupled with/to" or "connected to" another element (e.g., a second element), the certain element may be coupled to the other element directly or via another intermediary element (e.g., at least a third element). However, when a certain element (e.g., a first element) is referred to as being "directly coupled" or "directly connected" to another element (e.g., a second element), there may be no intervening element (e.g., a third element) between the element and the other element.

The term "configured (or set) to" as used in the disclosure may be interchangeably used with the term, for example, "suitable for", "having the capacity to", "designed to", "adapted to", or "made to", or "capable of". The term "configured (or set) to" may not necessarily have the meaning of "specifically designed to". In some cases, the term "device configured to" may indicate that the device "may perform" together with other devices or components. For example, the term "processor configured (or set) to perform A, B, and C" may represent a dedicated processor (e.g., an embedded processor) for performing a corresponding operation, or a generic-purpose processor (e.g., a CPU or an application processor) for executing at least one software program stored in a memory device to perform a corresponding operation. In any event, in the appended claims such terms are to be interpreted within a statutory context (not as software per se, for example).

The terminology used herein is only used for describing specific embodiments and is not intended to limit the scope of other embodiments. The terms of a singular form is not limited to a single form may include plural forms unless otherwise specified. The terms used herein, including technical or scientific terms, have the same meanings as understood by those skilled in the art. Commonly-used terms defined in a dictionary may be interpreted as having meanings that are the same as or similar to contextual meanings defined in the related art, and should not be interpreted in an idealized or overly formal sense unless otherwise defined explicitly. Depending on the circumstances, even the terms expressly defined herein should not be such interpreted as to exclude various embodiments of the present disclosure.

Hereinafter, an electronic device according to various embodiments of the present disclosure will be described with reference to the accompanying drawings. The term "user" used herein may refer to a person who uses (operates) an electronic device or may refer to a device (e.g., an artificial electronic device) that uses an electronic device.

FIG. 1 illustrates an audio output device according to various embodiments of the present disclosure.

Referring now to FIG. 1, an audio output device 100 may be embodied, for example, as a type of a headphone. However, an artisan appreciates that the description is provided for illustrative and explanatory purposes, and thus such structure shown is not limited to only a headphone but also may include other types of devices, such as, for example, an output device capable of receiving an audio signal through an AUX connection unit 110 or a Bluetooth (BT) connection unit 120 illustrated in FIG. 1 and outputting the audio signal (or a signal obtained by performing predetermined signal processing on a received audio signal) through an output unit 190 (e.g., a speaker) may correspond to the audio output device 100 described herein. For example, in the case of a typical earphone, a terminal of an AUX line integrated with the earphone may be connected to an AUX socket of a playback device to output an audio signal received from the playback device. However, other types of earphones may be equipped with an AUX socket such as the AUX connection unit 110, and such earphones may also correspond to the audio output device 100 described herein.

In the present disclosure, a playback device represents an electronic device that can provide an audio signal to the audio output device 100. The audio signal includes not only signals generated by playing audio/video files of various formats such as .mp3, .wav, or .flac but also arbitrary signals for outputting sounds to the audio output device 100. For example, a smartphone that communicates with another user terminal may output a voice of another user through an earphone connected to the smartphone by a wire, or a Bluetooth headset connected to the smartphone wirelessly. Herein, the smartphone may correspond to the playback device, and the earphone/headset may correspond to the audio output device 100.

Although the audio output device 100 illustrated in FIG. 1 includes both the AUX connection unit 110 and the BT connection unit 120, the audio output device 100 may selectively include only one of the connection units in various embodiments of the present disclosure. For example, an output device such as an earphone may include the AUX connection unit 110, and an output device such as a wireless BT headset may include the BT connection unit 120. In some various embodiments of the present disclosure, a certain output device may include both the AUX connection unit 110 and the BT connection unit 120, and, in this case, if a connection to a playback device through the AUX connection unit 110 is recognized, the BT connection unit 120 may release a BT connection to the playback device, or the BT connection may be maintained but an audio signal may be received through the AUX connection unit 110 instead of the BT connection unit 120. This operation may be performed by changing a path through which the playback device provides an output signal from the BT connection unit 120 to the AUX connection unit 110.

In an embodiment of the present disclosure, the AUX connection unit 110 and the BT connection unit 120 may be replaced with a wired connection module and a wireless connection module respectively. For example, the AUX connection unit 110 may receive an audio signal through an interface such as an arbitrary wired connection (e.g., USB or serial cable connection or the like) instead of an AUX-based connection. Furthermore, the BT connection unit 120 may receive an audio signal through short-range communications such as near field communication (NFC), Wi-Fi, Wi-Fi direct, or Bluetooth low energy (BLE) instead of a Bluetooth connection. In other words, the audio output device 100 may be provided with a communication interface for setting a wired connection or a wireless connection to a playback device that provides an audio signal.

In an embodiment of the present disclosure, if the audio output device 100 is connected to a playback device through the AUX connection unit 110 or recognizes itself as being connected to the playback device (e.g., one terminal of a 4 pole-3 pole (or 4 pole) 3.5pi earphone is connected to the AUX connection unit 110 but the earphone is not connected to the playback device), the audio output device 100 may be turned on. For example, a power 130 may be activated by connecting an AUX terminal to the AUX connection unit 110. However, in another embodiment of the present disclosure, in the case of a headphone which is not provided with the AUX connection unit 110 or is able to be turned on/off by a user, the power 130 may be manually turned on/off. If the power 130 is switched to a turned-on state, the power 130 may supply power to elements required for operating the audio output device 100. Although FIG. 1 illustrates connections among the power 130, the AUX connection unit 110, and a signal detector 140, such a connection relationship are only provided as an example for ease of description and does not limit a wiring structure of the audio output device 100. In various embodiments of the present disclosure, the power 130 may be connected, as appropriate, to other hardware elements.

In various embodiments of the present disclosure, it is assumed that the power 130 is in the turned-on state. In the case where the audio output device 100 includes the AUX connection unit 110, the power 130 may be switched to the turned-on state by connecting an AUX terminal to the AUX connection unit 110, and active noise cancellation (ANC) may be performed. In the case where the audio output device 100 includes the BT connection unit 120, the power 130 may be switched to the turned-on state by selecting a power switch (or button) by the user, and the ANC may be performed. In the case where the audio output device 100 includes both the AUX connection unit 110 and the BT connection unit 120, the power 130 may be switched to the turned-on state by performing one of the above-mentioned operations, and the ANC may be performed according to a connection state between the audio output device 100 and a playback device or a state of a received audio signal.

In various embodiments described below, the audio output device 100 may determine a level of the ANC required to be performed by the audio output device 100, according to a wired/wireless connection state between a playback device and the audio output device 100, and this level can be based on, for example, whether or not an audio signal is provided from the playback device, an intensity of an audio signal provided from the playback device, or a specified signal (e.g., a signal related to an activation state of an amplifier of the playback device or an audio codec) from the playback device. In other words, the audio output device 100 may provide two or more (a plurality of) ANC modes, and may select an appropriate ANC mode from among the plurality of modes according to the specific situation.

In general, the application of the ANC causes a change in a frequency response of heard by the person, for example, wearing a pair of headphones. Therefore, if the performance of the ANC is increased only in consideration of cancellation of an ambient noise, sound quality may be so deteriorated that the user may recognize the deterioration when an audio file such as a music file is played, and thus the user may not consider utilizing the ANC due to the reduced sound quality. Therefore, when outputting a normal audio signal such as a music file or a telephone call, the audio output device 100 may perform the ANC of ANC mode 1 in which sound quality deterioration (recognizable by the user) of the audio signal does not occur. However, if an audio signal is not provided or it is determined that an Rx level or volume of a provided audio signal is too low for the user to recognize it, the audio output device 100 may perform the ANC of ANC mode 2 in which noise cancellation is maximized. The above-mentioned ANC mode 1 or ANC mode 2 may represent the level or intensity of the ANC. For example, the ANC mode 1 and the ANC mode 2 may be construed as first-level ANC and second-level ANC respectively. Each ANC may have a specified value (e.g., a gain of a microphone for ANC), or may have a specified range. However, in any case, the second-level ANC provides stronger (more noise cancelation, resulting in a greater frequency reduction of an audio signal during a playback) ANC than the first-level ANC. In other words, a microphone gain for application of the second-level ANC is set to be higher than that for application of the first-level ANC.

Referring again to FIG. 1, the audio output device 100 may determine whether the audio output device 100 is connected to a playback device by wire or wirelessly through a communication interface. For example, in the case where a wired connection is set between the playback device and the audio output device 100, the AUX connection unit 110 may provide a wired connection information 113 to a micro control unit (MCU) 150. Furthermore, in the case where a wireless connection is set between the playback device and the audio output device 100, the BT connection unit 120 may provide wireless connection information 123 to the MCU 150. The settings of the wired connection information 113 and the wireless connection information 123 may be used to determine an ANC mode in the MCU 150.

If the audio output device 100 is connected to the playback device through the AUX connection unit 110 or the BT connection unit 120, the signal detector 140 may determine whether an audio signal is received and/or the intensity of a received audio signal, and may provide audio signal information 143 to the MCU 150. The audio signal information 143 may be used to determine an ANC mode in the MCU 150.

In some various embodiments of the present disclosure, if it is determined that the playback device is not connected to the audio output device 100, the MCU 150 may determine an ANC mode based on information provided from a communication interface (e.g., the AUX connection unit 110 or the BT connection unit 120), without using the audio signal information 143 (in this case, this information indicates non-existence of an audio signal). Furthermore, in some various embodiments of the present disclosure, the MCU 150 may determine an ANC mode based on the audio signal information 143 provided from the signal detector 140. Moreover, in other embodiments of the present disclosure, the MCU 150 may determine an ANC mode to be performed, based on at least one of the pieces of information provided from the MCU 150 (e.g., by performing an appropriately defined XOR operation on provided pieces of information).

The MCU 150 may select ANC to be applied to an output signal from among an ANC-1 170 or an ANC-2 180 by controlling a switch 160. The MCU 150 may be a computing device or a processing device such as a microprocessor. Depending on the size and power contrasts, and complexity, the particular type of MCU can vary greatly. In some various embodiments of the present disclosure, the MCU 150 may be replaced with a type of a control circuit operated based on a control signal (e.g., the wired connection information 113, the wireless connection information 123, the audio signal information 143, etc.). In other words, the MCU 150 is not limited to a microprocessor, and a type of a control circuit for determining the level of ANC to be applied may be satisfactorily used as the MCU 150.

The MCU 150 may determine the level of ANC to be performed in the audio output device 100. For example, the MCU 150 may be connected to an ANC circuit and configured so as to change the gain of a microphone for obtaining an ambient noise. In the case where the ANC is performed in a feedback manner, the MCU 150 may change the gain of a microphone disposed between a cavity or a hall formed between an ear of the user and the inside of a shell of the audio output device 100. In the case where the ANC is performed in a feedforward manner, the MCU 150 may change the gain of a microphone disposed outside the audio output device 100. In the case where the ANC is performed in a hybrid manner in which the feedback manner is combined with the feedforward manner, the MCU 150 may change the gains of both microphones.

The output unit 190 may output an audio signal to which a first-level ANC (e.g., the ANC-1 170) or a second-level ANC (e.g., the ANC-2 180) is applied. In this manner, in the case where a typical audio signal is provided from the playback device, the audio output device 100 may output a sound signal obtained by applying, to the audio signal, the first-level ANC for reducing an ambient noise without seriously deteriorating the audio signal, or, in the case where it is determined that no audio signal is provided from the playback device, the audio output device 100 may output an anti-noise signal by applying the second-level ANC for a relatively strong reduction in an ambient noise. In the case of applying the second-level ANC as described above, a noise (e.g., an audible hissing noise) that can be heard by the user may be generated due to the ANC. Therefore, a noise reducer for removing such an additional noise (i.e. removing the audible hissing noise) may be added. The noise reducer is described below in more detail with reference to FIG. 2.

Although FIG. 1 exemplarily illustrates an AUX connection or a BT connection between the playback device and the audio output device 100, i.e., one wired connection and one wireless connection, various embodiments of the present disclosure may be applied to at least two wired or wireless connections. For example, the audio output device 100 may establish an AUX connection, a BT connection, and a Wi-Fi direct connection to the playback device, and the MCU 150 may control an ANC level by analyzing signal information received through the three types of connections in the same or a similar manner. Such extension would not be difficult for those skilled in the art and falls within the scope of the present disclosure.

The configuration of the audio output device 100 illustrated in FIG. 1 is an example, and may be variously modified or extended so that the ANC described herein is implementable in many ways, as should be understood and appreciated by a person of ordinary skill. For example, although a microphone for obtaining a noise for ANC is not illustrated in FIG. 1, it would be understood by a person of ordinary skill that such a microphone may be an element of the audio output device 100. Furthermore, a transfer path of a signal or information may be variously modified. For example, the connection information 123 on the playback device obtained by the BT connection unit 120 is not required to be directly connected to the MCU 150, and may be provided to the MCU 150 via the signal detector 140 using a bypass method.

Various embodiments are described below with reference to FIGS. 2 to 7. Descriptions that are similar or correspond to or overlap with the above descriptions may be omitted below, but the omitted descriptions should not be construed as being excluded. Furthermore, the elements conceptually described with reference to FIG. 1 may correspond, as appropriate, to otherwise-named elements of FIGS. 2 to 4 which perform operations that are the same as or similar to those of the elements of FIG. 1.

Figure 2:
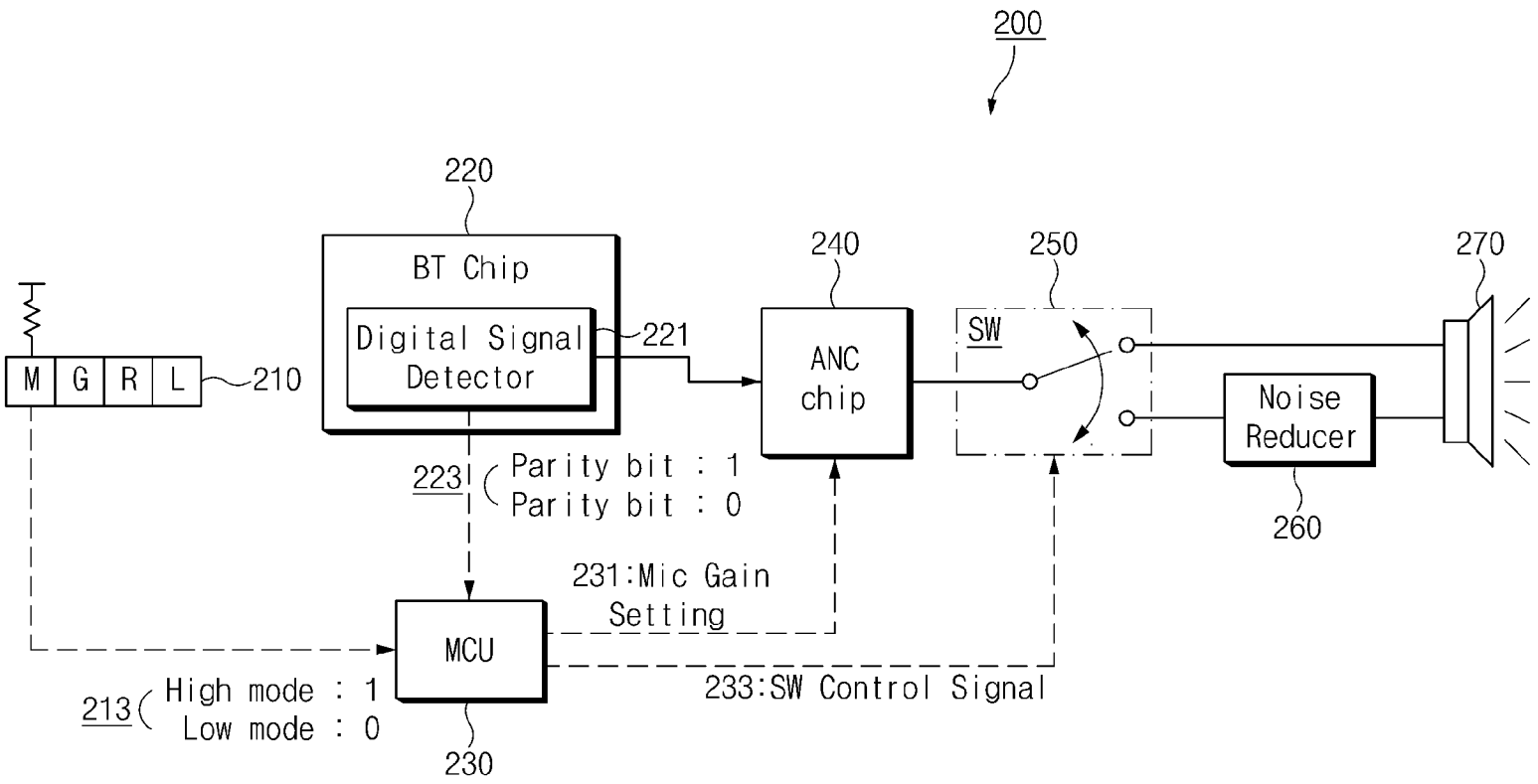
FIG. 2 illustrates an exemplary structural arrangement of ANC control according to a connection state and a playback state in an audio output device according to various embodiments of the present disclosure.

FIG. 2 illustrates exemplary ANC control according to a connection state and a playback state in an audio output device according to various embodiments of the present disclosure.

Referring now to FIG. 2, an audio output device 200 may include an ear connector 210. The ear connector 210 may correspond to the AUX connection unit 110 of the audio output device 100 of FIG. 1. One terminal of the AUX, for example, an ear jack, may be connected to the ear connector 210.

In general, an ear jack includes three poles corresponding to left (L), right (R), and ground (G) respectively. In the case where a playback device supports a microphone function, an ear jack terminal connected to the playback device may include four poles including an M (mic) pole for a microphone in addition to the L, R, and G poles. Also in this case, a terminal connected to an output device such as a headphone or an earphone may include three poles of L/R/M. In other words, an ear jack terminal connected to a playback device may include four poles of L/R/G/M or three poles of L/R/G, and an ear jack terminal connected to an output device may include three poles of L/R/M.

In an embodiment of the present disclosure, an ear jack terminal connected to the audio output device 200 may include four poles of L/R/G/M. In other words, in an embodiment of the present disclosure, an existing 4 pole-3 pole 3.5pi type may be replaced with a 4 pole-4 pole 3.5pi type. In addition, a communication interface of the audio output device 200 may include an ear connector with at least four poles for a wired connection to a playback device. If the power of the playback device is turned on while the playback device is connected to the audio output device 200 by an ear cable, a bias voltage is distributed to a pull-down resistor (e.g., a resistor connected to the M pole of the ear connector 210) of a headphone, and the ear connector 210 provides a high signal or a low signal to an MCU 230 according to a voltage on the M pole (microphone terminal), so that the audio output device 200 may determine information on whether the ear cable is inserted (or whether the playback device is connected).

Described below is an ANC operation performed in a state (e.g., a wireless mode) in which the playback device is not connected to the audio output device 200 by wire. In other words, the communication interface does not detect a wired connection.

The ear connector 210 may determine whether or not there is a change in a voltage of the M-pole terminal due to insertion of the ear cable, and, if it is determined that the ear cable is not inserted, i.e., if a current state is not a wired connection state (e.g. wireless), the ear connector 210 may operate in a high mode. For example, the ear connector 210 may output wired connection information (e.g., bit 1) to the MCU 230.

If it is determined that the audio output device 200 is connected to the playback device by wire, the ear connector 210 may operate in a low mode and may transmit other wired connection information (e.g., bit 0). An embodiment in which the ANC is applied in the wired connection state is described below with reference to FIG. 4.

If the audio output device 200 is not connected to the playback device by wire, the audio output device 200 may then determine whether the audio output device 200 is wirelessly connected to the playback device. For example, a BT chip (or a BT module) 220 may include a digital signal detector 221 therein. In some various embodiments of the present disclosure, the digital signal detector 221 may be disposed outside the BT chip 220 like the signal detector 140 illustrated in FIG. 1. Furthermore, in various embodiments of the present disclosure, the BT chip 220 may be construed as a wireless communication module or a radio frequency integrated chip (RFID) as described above.

The digital signal detector 221 may determine whether a digital audio signal is provided from the playback device through the BT chip 220. If an audio signal provided from the playback device is detected, the digital signal detector 221 may transmit, to the MCU 230, predetermined wireless connection information, for example, parity bit 1. If an audio signal from the playback device is not detected, the digital signal detector 221 may transmit a parity bit 0 to the MCU 230.

In some various embodiments of the present disclosure, the BT chip 220 may determine whether BT paring is set (or BT communication channel is established) between the audio output device 200 and the playback device. If it is determined that the BT paring is not set, the BT chip 220 may transmit a parity bit 0 to the MCU 230. In this case, an operation of the digital signal detector 221 may be skipped.

The MCU 230 may determine an ANC level based on information provided from the ear connector 210 and the BT chip 220. For example, if it is determined that an audio signal is received wirelessly, the MCU 230 may transmit a microphone gain setting signal 231 to an ANC chip 240 (or to an ANC module or an ANC circuit). In this case, the microphone gain setting signal may indicate a microphone gain for first-level ANC which minimizes a change in a frequency response and a generation level of a hiss noise. If it is determined that an audio signal is not received, the microphone gain setting signal 231 received from the MCU 230 to the ANC chip 240 may indicate a microphone gain for second-level ANC which maximizes a nose cancellation amount within an allowable threshold, since the change in the frequency response is not affected in the case of non-existence of an audio signal.

If the microphone gain is increased due to application of the second-level ANC, an unintended audible audio artifact such as a hissing noise may be generated. Therefore, in an embodiment of the present disclosure, the MCU 230 may transmit a switch control signal 233 to a switch 250. An input terminal of the switch 250 may be connected to the ANC chip 240, and an output terminal of the switch 250 may be selectively connected to an output unit 270 or a noise reducer 260. The switch control signal 233 may allow an audio signal to be directly provided to the output unit 270 when the first-level ANC is applied, or, when the second-level ANC is applied, the switch control signal 233 may allow an output signal to be provided to the output unit 270 via the noise reducer 260 (or a noise cancellation block, a noise cancellation circuit, or the like).

In an embodiment of the present disclosure, the noise reducer 260 may comprised an appropriately configured (analog) notch filter circuit. A notch filter may include, for example, C and R elements. However, in various embodiments of the present disclosure, a circuit or a module for cancelling a noise generated due to application of the second-level ANC may be satisfactorily used as the noise reducer 260, and thus another type of filter or circuit may be used therefor. Furthermore, the noise reducer 260 may be implemented using at least two noise cancellation modules.

In some various embodiments of the present disclosure, the MCU 230 may determine an ANC level by performing an XOR operation. For example, the MCU 230 may perform the XOR operation on information (e.g., parity bit 1 or 0) on existence of an audio signal provided from the BT chip 220 and wired connection information (e.g., bit 1 for the high mode in the case of the wireless mode) provided from the ear connector 210. In this case, the MCU 230 may set the microphone gain according to the first-level ANC if a result of the XOR operation is 0, or the MCU 230 may set the microphone gain according to the second-level ANC if the result of the XOR operation is 1.

In various embodiments of the present disclosure, the XOR operation or another-type operation may be appropriately modified and set in consideration of a circuit configuration or various conditions. However, even in such a case, various embodiments of the present disclosure may define an operation to be performed in the MCU 230 so that, for example, the first-level ANC is applied (ANC mode 1) in the case of existence of an audio signal, or the second-level ANC is applied (ANC mode 2) in the case of non-existence of an audio signal.

Figure 3:
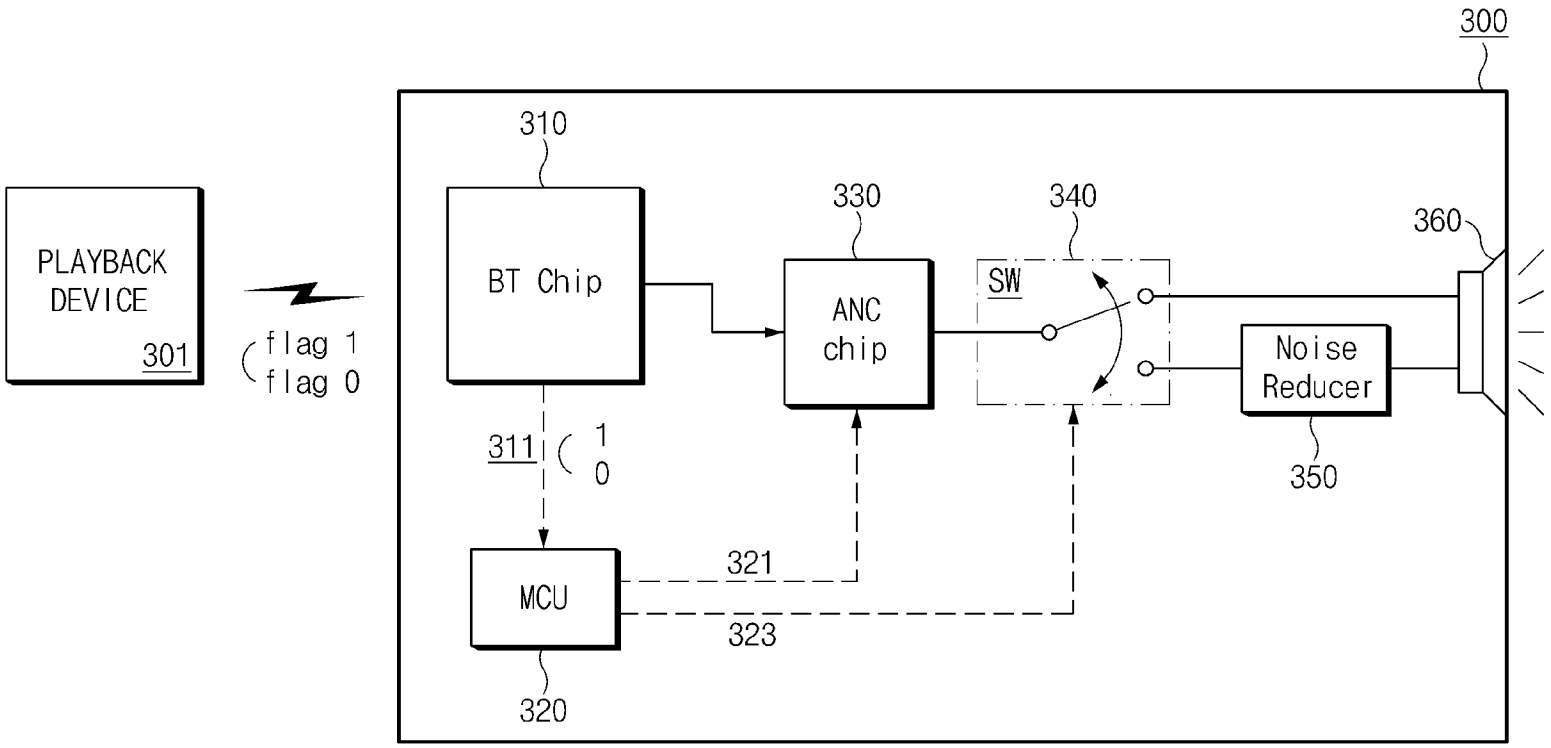
FIG. 3 illustrates ANC control according to a signal received from a playback device in an audio output device according to various embodiments of the present disclosure.

FIG. 3 illustrates ANC control according to a signal received from a playback device in an audio output device according to various embodiments of the present disclosure.

An audio output device 300 may be in a state of being wirelessly connected to a playback device 301. For example, the audio output device 300 may be in a state of being BT-paired with the playback device 301 through a BT chip 310.

The playback device 301 may determine whether an audio codec (or amplifier) for outputting (or transmitting) an audio signal therefrom is activated, and may transmit audio codec activation (ON/OFF) information to the audio output device 300. For example, the playback device 301 may set a flag bit as 1 if the audio codec is activated, or the playback device 301 may set the flag bit as 0 if the audio codec is inactivated, and then the playback device 301 may transmit the flag bit to the audio output device 300. Here, activation of the audio codec may represent that the playback device 301 transmits an audio signal to the audio output device 300.

The BT chip 310 may provide a bit value to an MCU 320 according to bit information received from the playback device 301. For example, the BT chip 310 may transmit intact, to the MCU 320, a bit value received from the playback device 301. However, in some various embodiments of the present disclosure, the BT chip 310 may provide a bit value different from the received bit value so that the bit value is suitable for a specific operation (e.g. the XOR operation).

The MCU 320 may provide a microphone gain setting signal 321 to an ANC chip 330, and may transmit a switch control signal 323 to a switch 340. For example, if the MCU 320 obtains information indicating activation of the audio codec of the playback device 301, the MCU 320 may provide a signal for setting the gain of a microphone connected to the ANC chip 330 as a gain for the first-level ANC, and the MCU 320 may provide to the switch 340, a signal for allowing the switch 340 to directly transfer an audio signal to an output unit 360. However, if the MCU 320 obtains information indicating inactivation of the audio codec of the playback device 301, the MCU 320 may provide a signal for setting the gain of the microphone connected to the ANC chip 330 as a gain for the second-level ANC since the obtained information indicates that there is no audio signal provided from the playback device 301 through the audio output device 300. Furthermore, the MCU 320 may provide the switch control signal 323 so that the switch 340 is connected to a noise reducer 350 in order to remove a noise that may be generated due to an increased microphone gain. In some various embodiments of the present disclosure, in the case where the second-level ANC does not cause generation of a hiss noise or the level of a generated hissing noise is so low that the noise reducer 350 is not required, the switch control signal 323 may directly connect the ANC chip 330 to the output unit 360. In other words, according to various embodiments of the present disclosure, a filter may be applied in order to remove an additional noise that may be generated when the ANC performed by the audio output device 100, 200, or 300 is set to be high (e.g., the second level), but a change of an ANC mode is not necessarily accompanied by a noise removal operation.

FIG. 3 illustrates operation performed in a state in which the playback device 301 is connected to the audio output device 300 via a wireless network. However, the operation described above with reference to FIG. 3 may be appropriately modified for a state in which the playback device 301 is connected to the audio output device 300 by wire. For example, in the case where a playback device and an output device are connected to each other through the AUX connection unit 110 of FIG. 1 or the ear connector 210 of FIG. 2, the playback device may provide, to the output device, information on whether an audio codec is activated. This information may be provided to a control unit of an output device, and an operation performed thereafter has been described above in relation to the MCU 320.

Figure 4:
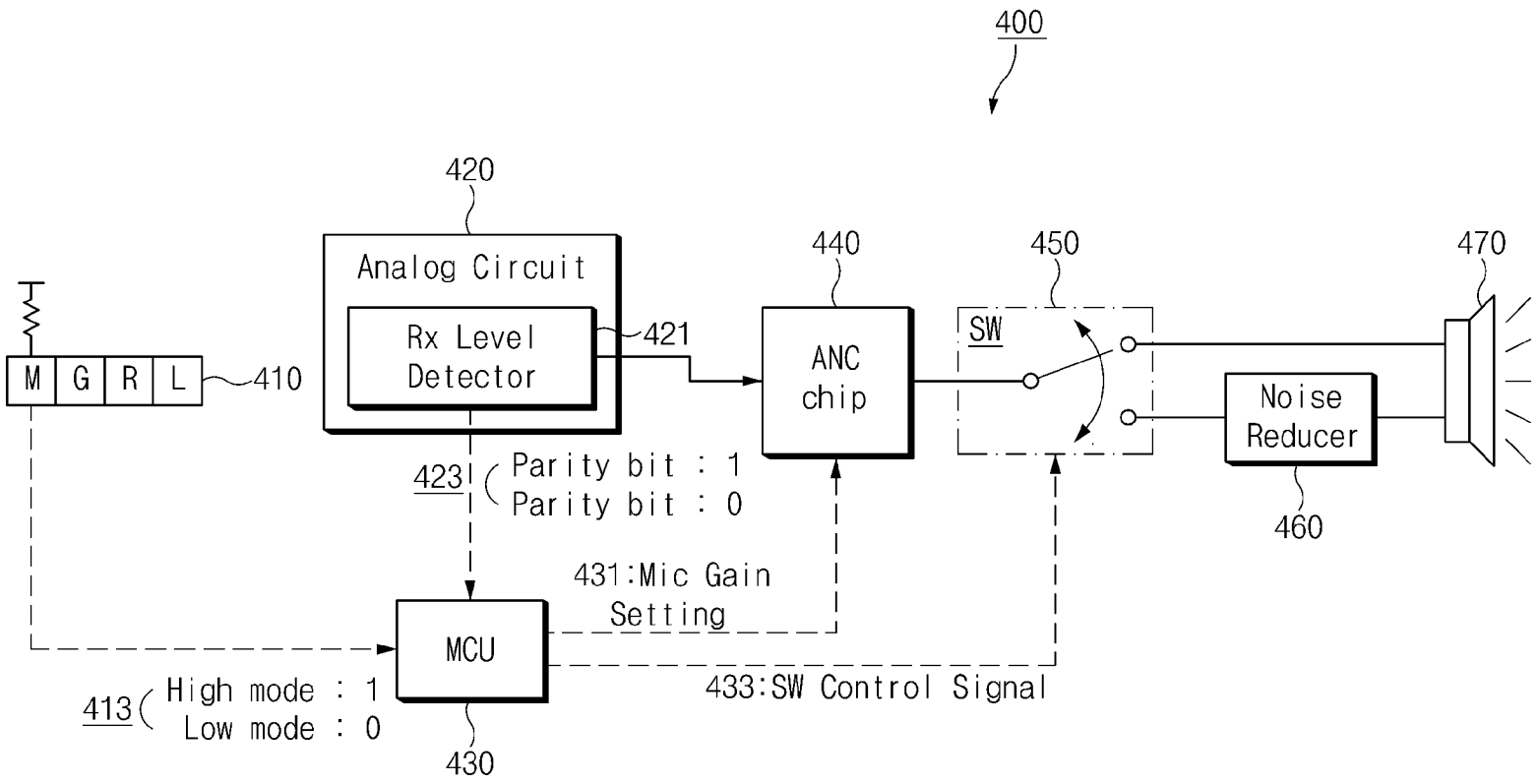
FIG. 4 illustrates ANC control according to an Rx level of a received audio signal in an audio output device according to various embodiments of the present disclosure.

FIG. 4 illustrates ANC control according to an Rx level of a received audio signal in an audio output device according to various embodiments of the present disclosure.

Referring to FIG. 4, an ear connector 410, an MCU 430, an ANC chip 440, a switch 450, a noise reducer 460, and an output unit 470 may respectively correspond to the ear connector 210, the MCU 230, the ANC chip 240, the switch 250, the noise reducer 260, and the output unit 270 of FIG. 2. Overlapping descriptions will be omitted.

If it is determined that an audio output device 400 is connected to a playback device by wire, the ear connector 410 may be operated in a low mode and may transmit wired connection information (e.g., bit 0) to the MCU 430. In the case where a wired connection is not set between the audio output device 400 and the playback device, the ear connector 410 may be operated in a high mode, and may transmit other wired connection information (e.g., bit 1).

An audio signal received from the playback device may be detected by an analog circuit 420. The analog circuit 420 may include a reception level detector 421. The reception level detector 421 may correspond to a type of a comparator. The reception level detector 421 may determine an intensity (or level) of a detected signal, and may determine that an audio signal is provided from the playback device if the signal intensity is equal to or higher than a threshold. In this case, the reception level detector 421 may transmit parity bit 1 as audio signal information 423 to the MCU 430. If the signal intensity is lower than the threshold, the reception level detector 421 may determine that an audio signal is not provided from the playback device. In this case, the reception level detector 421 may transmit parity bit 0 as the audio signal information 423 to the MCU 430.

The MCU 430 may determine whether an audio signal is currently provided to the audio output device 400 based on obtained information, and may control the ANC chip 440 and/or the switch 450. For example, the MCU 430 may transfer an appropriate microphone gain setting signal 431 to the ANC chip 440, and may transfer an appropriate switch control signal to the switch 450.

Figure 5:
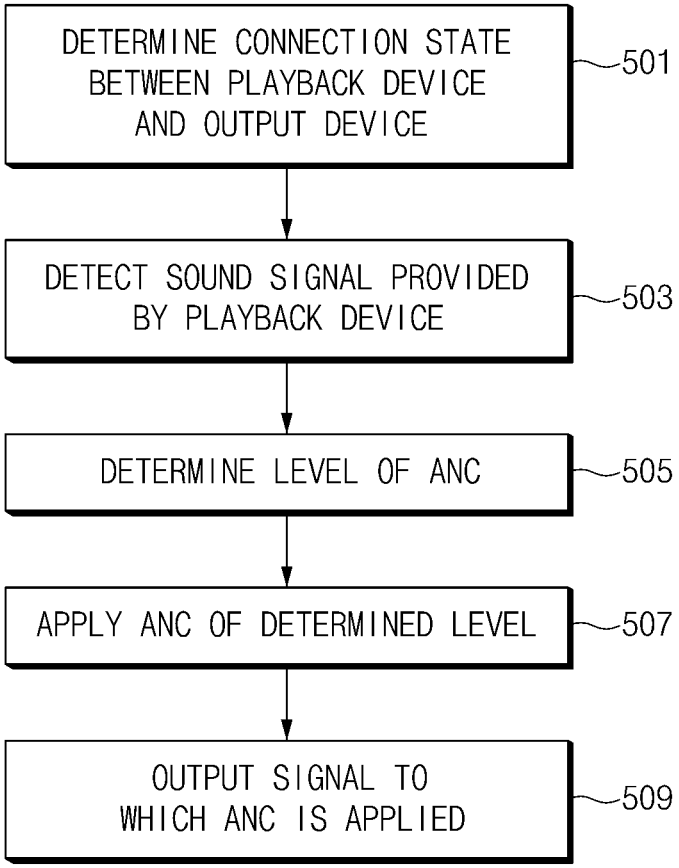
FIG. 5 illustrates an ANC control method of an audio output device according to various embodiments of the present disclosure.

FIG. 5 illustrates an ANC control method of an audio output device according to various embodiments of the present disclosure.

In operation 501, an output device may determine a wired or wireless connection state between a playback device and the output device. For example, the output device may determine whether the output device is connected to the playback device by wire such as AUX or an ear cable or by a wireless network such as BT, NFC, or Wi-Fi direct.

In operation 503, the output device may detect an audio signal provided by a playback device. Operation 503 may not be performed if it is determined that the playback device is not connected to the output device in any way in operation 501. In this case, the process may directly proceed to operation 505 from operation 501.

In some various embodiments of the present disclosure, operation 501 may be skipped. In other words, the output device may detect a sound signal provided by the playback device, and may perform an ANC control operation based on the sound signal.

In operation 503, the output device may determine a level of ANC to be applied, based on at least one of a connection state between the playback device and the output device or a detected audio signal. For example, in the case where an audio signal is received from the playback device, the output device may determine to apply the first-level ANC which is a normal-level ANC. However, in the case where it is determined that the output device and the playback device are not connected to each other or there is no audio signal received from the playback device, or an audio signal received from the playback device is not considered to be meaningful since the audio signal is very week, the output device may apply the second-level ANC which maximizes the noise cancellation amount.

In operation 507, the output device may apply ANC of a determined level. For example, the output device may transfer, to an ANC circuit (or a microphone control unit), a control signal for determining a gain of a microphone (e.g., one or more microphones used for the feedback, feedforward, or hybrid manner) connected to the ANC circuit, according to a result of determination of operation 505. The ANC circuit may set the gain of the microphone based on the control signal. The output device may obtain a noise around the output device through the microphone, may generate an anti-noise signal based on the obtained noise, and may apply the anti-noise signal to a signal to be output.

In operation 509, the output device may output an ANC-applied signal. According to a series of the operations as described above, the output device may provide a clear sound quality or call environment while cancelling an ambient noise in a situation such as listening to music or calling for which an audio signal is received from the playback device, and the output device may provide a more quiet and calmer situation by increasing the amount of ambient noise cancellation in a situation in which an audio signal is not received from the playback device.

Figure 6:
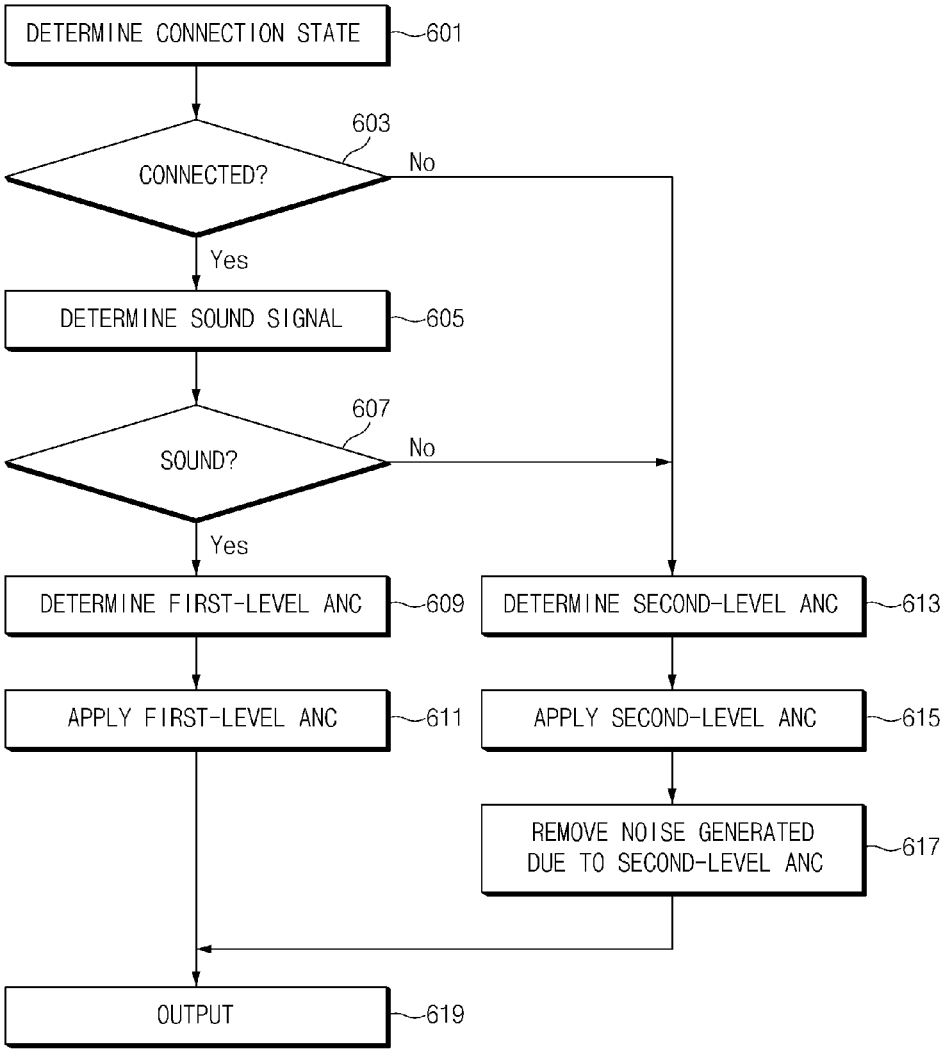
FIG. 6 illustrates an exemplary ANC control method according to a connection state and a playback state in an audio output device according to various embodiments of the present disclosure.

FIG. 6 illustrates an exemplary ANC control method according to a connection state and a playback state in an audio output device according to various embodiments of the present disclosure.

Referring now to FIG. 6, in operation 601, an output device may determine a connection state between the output device and a playback device. If in operation 603, it is determined that the output device is connected to the playback device wirelessly or by wire, then at operation 605 output device may determine a sound signal has been sent through the connection. However, if in operation 603 it is determined that the output device is not connected to the playback device, then in operation 613 the output device can apply the second-level ANC.

If in operation 607, it is determined that a sound signal is provided from the playback device, then in operation 609 the output device applies the first-level ANC in operation 609.

In operation 611, the output device may apply the first-level ANC, and, in operation 619, the output device may output the sound signal of which a hissing noise falls within an allowable range and of which a frequency response deformation/distortion is equal to or lower than a reference value. In operation 615, the output device applies the second-level ANC. Compared to the first-level ANC, the second-level ANC may cause a more pronounced distortion in the frequency response, which can result, for example, in a stronger hissing noise than when applying the first-level ANC. In operation 617, the output device may remove a noise that may be generated due to application of the second-level ANC. For example, the output device may reduce or remove a hissing noise generated due to application of ANC using a noise reduction filter such as a notch filter. In operation 619, the output device may output an anti-noise signal against an ambient noise that may for example, be filtered to remove a hissing noise or noise in a notch frequency because of the application of the second-level ANC so that a noiseless or at least a reduced noise environment may be provided to the user as a result.

Figure 7:
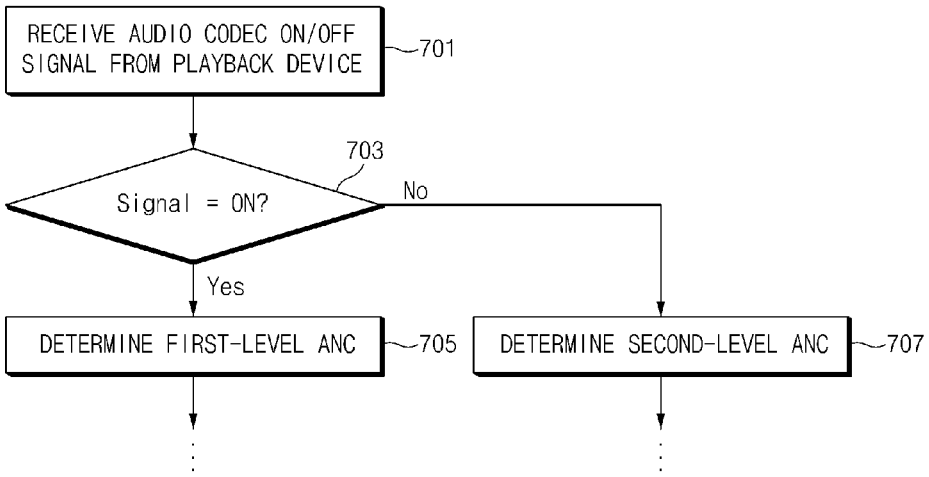
FIG. 7 illustrates an ANC control method according to a signal received from a playback device in an audio output device according to various embodiments of the present disclosure.

FIG. 7 illustrates an ANC control method according to a signal received from a playback device in an audio output device according to various embodiments of the present disclosure.

Referring now to FIG. 7, in operation 701, an output device may receive an audio codec on/off signal from a playback device, indicating whether an audio codec of the playback device is activated or not. If in operation 703, the signal received by the output device indicates a turned-on state (activated state) of the audio codec, the output device determines that an audio signal is received from the playback device and at operation 705, applies the first-level ANC. Operations following operation 705 may correspond to operation 609 and the following operations of FIG. 6 or may be performed in a similar manner.

However, if in operation 703, the signal received by the output device indicates a turned-off state (inactivated state) of the audio codec. Thus, in operation 707, the output device may determine that there is no audio signal received from the playback device and applies the second-level ANC. Operations following operation 707 may correspond to operation 613 and the following operations of FIG. 6 or may be performed in a similar manner.

The term "module" used herein is a statutory element that may represent, for example, a unit including one of hardware, software and firmware or a combination thereof. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific integrated circuit (ASIC) chip, a field-programmable gate array (FPGA), and a programmable-logic device for performing some operations, which are known or will be developed.

At least a portion of the functions of devices (e.g., modules or functions thereof) or methods (e.g., operations) according to various embodiments of the present disclosure may be implemented as instructions stored in a computer-readable storage medium in the form of a program module.

For example, a non-transitory storage medium according to an embodiment of the present disclosure may store instructions that, when executed by hardware such as a processor, cause an audio output device to perform functions including determining a state of connection between a playback device and the output device, detecting an audio signal transferred through the connection, determining a level of ANC to be applied based on at least one of the state of the connection or the audio signal, and performing the ANC of a determined level on a signal to be output.

The module or program module, which under their broadest reasonable interpretation do not constitute software pure se, according to various embodiments of the present disclosure may include at least one of the above-mentioned elements, or some elements may be omitted or other additional elements may be added. Operations performed by the module, the program module or other elements according to various embodiments of the present disclosure may be performed in a sequential, parallel, iterative or heuristic way. Furthermore, some operations may be performed in another order or may be omitted, or other operations may be added.

According to various embodiments of the present disclosure, an effective noise cancellation is provided to a user based on a signal transfer state or a connection state between an audio output device and a playback device.

The apparatuses and methods of the disclosure can be implemented in hardware, and in part as firmware or via the execution of software or computer code in conjunction with hardware that is stored on a non-transitory machine readable medium such as a CD ROM, a RAM, a floppy disk, a hard disk, or a magneto-optical disk, or computer code downloaded over a network originally stored on a remote recording medium or a non-transitory machine readable medium and stored on a local non-transitory recording medium for execution by hardware such as a processor, so that the methods described herein are loaded into hardware such as a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc., that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. In addition, an artisan understands and appreciates that a "processor", "microprocessor" "controller", or "control unit" constitute hardware in the claimed disclosure that contain circuitry that is configured for operation. Under the broadest reasonable interpretation, the appended claims constitute statutory subject matter in compliance with 35 U.S.C. §101 and none of the elements are software per se. No claim element herein is to be construed under the provisions of 35

U.S.C. 112, sixth paragraph, unless the element is expressly recited using the phrase "means for".

The definition of the terms "unit" or "module" as referred to herein are to be understood as constituting hardware circuitry, such as, a CCD, CMOS, SoC, AISC, FPGA, a processor or microprocessor (a controller or control unit) with integrated circuitry configured for a certain desired functionality, or a communication module containing hardware such as transmitter, receiver or transceiver, or a non-transitory medium comprising machine executable code that is loaded into and executed by hardware for operation, in accordance with statutory subject matter under 35 U.S.C. §101 and do not constitute software per se. For example, the image processor in the present disclosure and any references to an input unit and/or an output unit both comprise hardware circuitry configured for operation.

The above embodiments of the present disclosure are illustrative and not limitative. Various alternatives and equivalents are possible. Other additions, subtractions, or modifications are obvious in view of the present disclosure and are intended to fall within the scope of the appended claims.

What is claimed is:

1. An audio output device comprising:

a communication interface including one or more of a wired or wireless connection to a playback device;

a signal detector configured to detect an audio signal received through the communication interface;

a control circuit configured to determine a particular level of active noise cancellation (ANC) to be applied to the audio signal;

an ANC module configured to apply the particular level of ANC determined by the control circuit, wherein the ANC module applies a first-level ANC to the audio signal, and wherein the ANC module is electronically connected to the control circuit and is controlled by the control circuit; and when the control circuit determines that the audio signal has not been detected based on information received from at least one of the communication interface and the signal detector, the control circuit controls the ANC module to perform a second-level ANC, wherein the control circuit determines the particular level of the ANC to be applied by the ANC module as the second level upon receiving, from the communication interface, information indicating that the wired or wireless connection is not established between the audio output device and the playback device.

2. The audio output device of claim 1, wherein the ANC module performs the second-level ANC to the audio signal by increasing a gain of a microphone connected to the ANC module to be higher than a gain for an application of the first-level ANC.

3. The audio output device of claim 2, wherein the ANC module receives a noise through the microphone and performs the ANC on the noise in a feedforward, feedback, or hybrid manner.

4. The audio output device of claim 1, further comprising a noise reducer configured to remove a noise generated due to performance of the second-level ANC.

5. The audio output device of claim 4, wherein the noise reducer comprises a notch filter circuit, and wherein the notch filter circuit is configured to remove a hissing noise generated by performance of the second-level ANC.

6. The audio output device of claim 1, wherein the control circuit determines the level of the ANC to be applied by the ANC module as the second level upon receiving, from the communication interface, information indicating that the audio output device is connected to the playback device by wire and receiving, from the signal detector, information indicating that a level of the audio signal is lower than a threshold value.

7. The audio output device of claim 6, wherein the communication interface further comprises an ear connector including at least four poles for wired connection to the playback device, and wherein, when a connection to a microphone terminal of the ear connector is detected, the communication interface outputs to the control circuit, information indicating that the audio output device is connected to the playback device by wire.

8. The audio output device of claim 1, wherein the control circuit determines the level of the ANC to be applied by the ANC module as the first level upon receiving, from the communication interface, information indicating that the audio output device is connected to the playback device wirelessly and receiving, from the signal detector, information indicating that a digital audio signal is received through the wireless connection.

9. The audio output device of claim 1, wherein the communication interface provides to the control circuit an audio codec on/off information of the playback device received from the playback device, and wherein the control circuit determines the level of the ANC to be applied based on the audio codec on/off information.

10. An audio output device comprising:

an active noise cancellation (ANC) module configured to perform ANC using a noise received through at least one microphone; and a control circuit configured to determine a gain of the at least one microphone and electronically connected to the ANC module, wherein the control circuit determines the gain of the microphone as a first level of gain when it is determined that an audio signal is received from a playback device connected to the audio output device by wire or wirelessly; and wherein the control circuit determines the gain of the microphone as a second level of gain when the audio signal is not received from the playback device, and wherein the second level of gain is higher than the first level of gain.

11. The audio output device of claim 10, wherein the control circuit determines the gain of the microphone as the second level when the playback device is not connected to the audio output device by wire or wirelessly.

12. The audio output device of claim 10, wherein the audio output device includes a switch module having an input terminal connected to the ANC module and an output terminal selectively connectable to an output unit or to a noise reducer circuit, and wherein, when the control circuit determines that the audio signal has not been transferred, the control circuit controls the switch module so that the ANC module is connected to the noise reducer.

13. The audio output device of claim 10, wherein the control circuit determines the gain of the microphone based on audio codec on/off information received from the playback device by wire or wirelessly.

14. An active noise cancellation (ANC) method of an output device, comprising:

determining a state of connection of a communication interface between a playback device and the output device;

detecting an audio signal received through the connection;

determining a particular level of ANC to be applied based on at least one of the state of the connection or state of the audio signal; and performing the ANC at a determined level on a signal to be output, wherein the performing the ANC comprises:

applying a first level of the ANC to the audio signal when it is determined that the playback device is connected to the output device and the audio signal is provided from the playback device to the output device; and applying a second level of the ANC to an output signal when it is determined that the playback device is connected to the output device but the audio signal is not provided from the playback device to the output device.

15. The ANC method of claim 14, wherein the performing the ANC comprises:

setting a gain of a microphone connected to an ANC circuit based on the particular level;

receiving a noise through the microphone; and applying the ANC to a signal to be output based on a value of the received noise.

16. The ANC method of claim 15, wherein the performing the ANC further comprises reducing a noise generated due to application of the ANC using a noise reduction filter, with respect to the signal to which the ANC is applied.

17. The ANC method of claim 14, wherein the second level of ANC causes a larger amount of a frequency response distortion compared to the ANC of the first level.

18. The ANC method of claim 17, wherein the performing of the ANC comprises applying the second level of the ANC to the output signal when it is determined that the playback device is not connected to the output device.

* * * * *